US005795079A

United States Patent [19]

Jonsson et al.

[11] Patent Number: 5,795,079

[45] Date of Patent: Aug. 18, 1998

[54] SHAFT BEARING IN A ROCK AND GROUND-DRILLING MACHINE

[75] Inventors: Gunnar Jonsson, Täby; Ulf Nordqvist, Stockholm, both of Sweden

[73] Assignee: Atlas Copco Craelius AB, Sweden

[21] Appl. No.: 663,216

[22] PCT Filed: Dec. 8, 1994

[86] PCT No.: PCT/SE94/01184

§ 371 Date: Jun. 7, 1996

§ 102(e) Date: Jun. 7, 1996

[87] PCT Pub. No.: WO95/16101

PCT Pub. Date: Jun. 15, 1995

[30] Foreign Application Priority Data

Dec. 10, 1993 [SE] Sweden ..... 9304120

[51] Int. Cl.[6] ..... E21C 1/10

[52] U.S. Cl. ..... 384/547; 173/149; 173/216; 175/170

[58] Field of Search ..... 384/490, 537, 384/547; 173/149, 216; 175/170, 189

[56] References Cited

U.S. PATENT DOCUMENTS

| | | | |
|---|---|---|---|
| 2,904,938 | 9/1959 | Bassoff | 384/547 X |
| 3,613,804 | 10/1971 | Jonsson | 173/149 |
| 4,637,477 | 1/1987 | Jonsson | 173/149 |
| 4,643,262 | 2/1987 | Jonsson | 173/149 |
| 4,877,094 | 10/1989 | Ebeling | 175/170 |

*Primary Examiner*—Thomas R. Hannon
*Attorney, Agent, or Firm*—Barnes & Thornburg

[57] ABSTRACT

A rock or ground-drilling machine includes a gear housing (14) in which there is journalled a shaft (31) which surrounds a drill string (23) in the manner of a sleeve and which is affixed to the drill string by means of a chuck (7) connected to the shaft (31). the chuck is operated by means of pressure fluid delivered to the chuck (27) through the medium of a commutator (36) acting between the gear housing (14) and the shaft (31). the shaft (31) is journalled in the gear housing (14) by means of one single rolling bearing (39). the commutator (36) lies resiliently against the gear housing (14) and is flexible in response to sideways movement of the shaft (31).

5 Claims, 2 Drawing Sheets

35
33
31
33
32
34
39
28
14
30
30
36
29
37
36
38
27

36
43
40
31
38
41
42
40
43

SHAFT BEARING IN A ROCK AND GROUND-DRILLING MACHINE

The present invention relates to a shaft bearing in a rock and ground-drilling machine which includes a gear housing in which there is journalled a shaft which embraces a drill string in the manner of a sleeve and which is secured to the shaft with the aid of a chuck connected thereto, wherein the chuck is manoeuvred by means of pressure fluid which is delivered to the chuck through the medium of a commutator which acts between the gear housing and the shaft.

A shaft bearing of this kind is known, for instance, from SE 324 747. In the case of this known shaft bearing, the drill shaft is journalled in at least two journal bearings. This requires accurate manufacture with regard to the angular correctness and the concentricity between the bearing positions. In addition, when the gear housing is comprised of two parts, these parts must be made to match one another and must therefore be sold in pairs as spare parts and must not be mixed together when several gear housings are repaired at one and the same time. Despite this matching of the gear housing parts, it is necessary to expect some deviation from a perfect form and from perfect measurement tolerances, and it is therefore necessary to provide the journal bearings with a certain clearance.

The object of the present invention is to eliminate the aforesaid problems and to provide a shaft bearing which will enable the shaft to adjust freely in the bearing without jamming or binding therein. In the case of impact drilling, or hammer drilling, it is also an advantage when the journal bearing is completely free of any play, or when the bearing is pre-stressed. This object is achieved with a shaft bearing according to claim 1. The depending Claims define suitable embodiments that further assist in achieving this solution.

Figure 1:
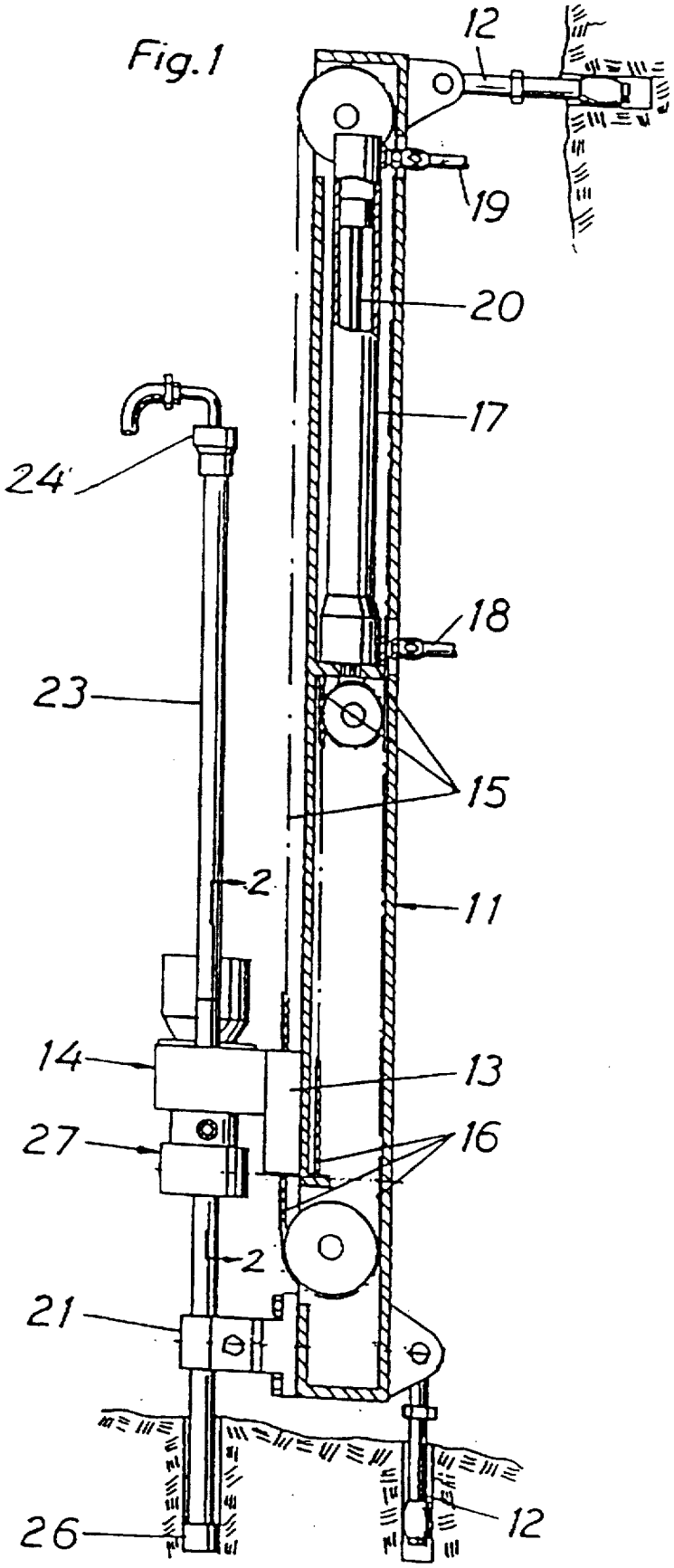
Figures 2, 3:
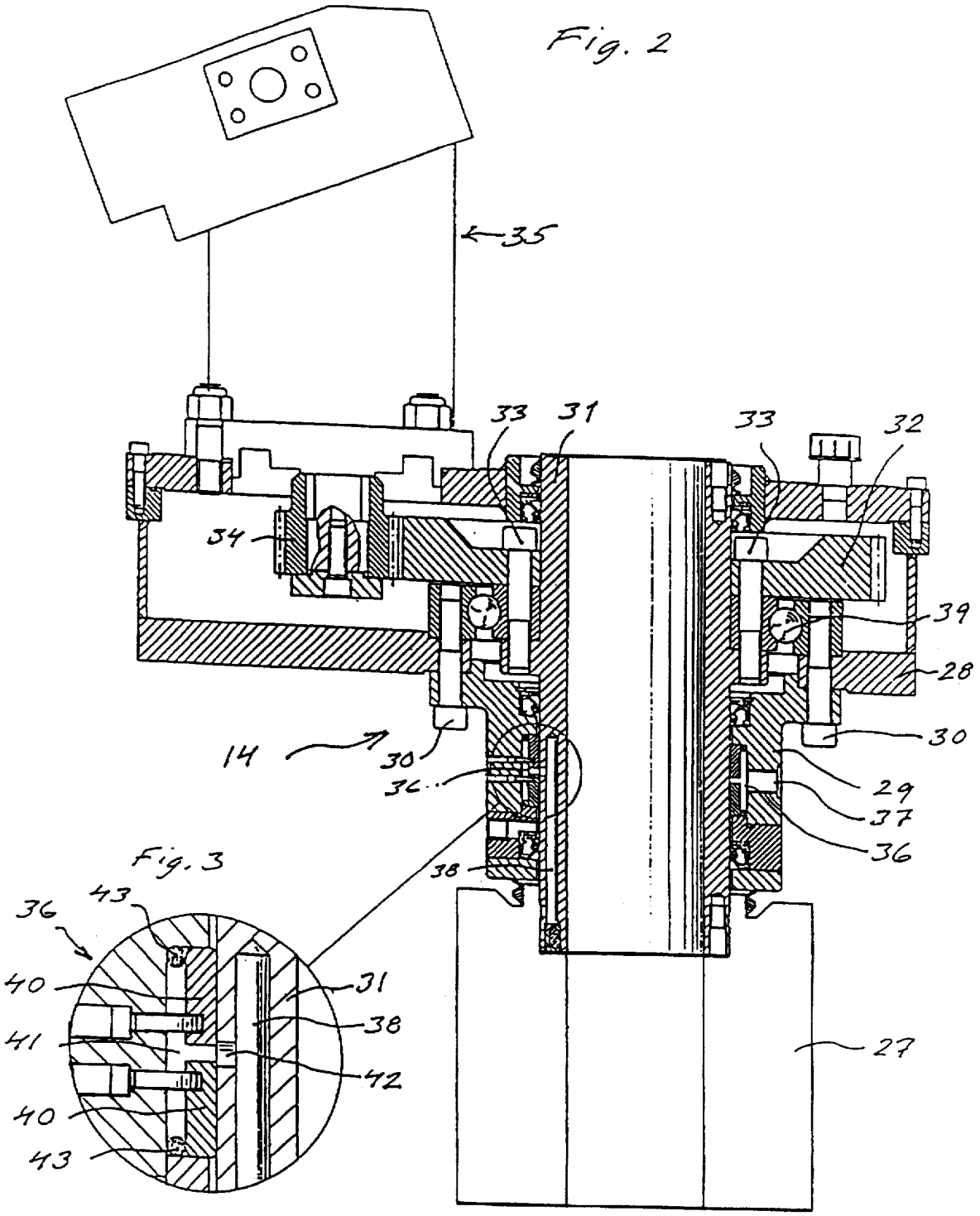

The invention will now be described in more detail with reference to the accompanying drawings, in which FIG. 1 is a side view, partly in section, of a rock and ground-drilling machine which includes an inventive shaft bearing;

FIG. 2 is a sectional view of the drill gear-housing, taken on the line 2—2 in FIG. 1; and FIG. 3 is an enlarged view of part of FIG. 2.

The drill illustrated in FIG. 1 includes a feed bar 11 which is supported in rock by expansion bolts 12. It will be understood, however, that the feed bar 11 may be supported in some other way, for instance by means of a wheeled carriage. The drilling machine also includes a gear housing 14 which is supported by a slide 13 which can be moved along the feed beam 11 with the aid of chains 15, 16, and a drive motor in the form of a piston-cylinder device 17, which includes two delivery lines 18, 19. When pressure fluid is delivered through the delivery line 18, the piston rod 20 is moved upwards in FIG. 1 and the chain 16 will pull the slide 13 downwards in FIG. 1. When pressure fluid is delivered through the line 19 instead, the slide 13 will be pulled upwards by the chains 15.

The front end of the feed beam 11 carries a chuck 21 which functions to grip and release a drill string, for instance a drill tube 23. The drill string 23 is comprised of a plurality of drill string elements, i.e. tube sections which are mutually screwed together, and a drill bit 26. In the case of rock drilling, the drill bit 26 may have the form of a tubular diamond drill bit and the first tube section may have the form of a so-called core tube for collecting drill core. The machine also includes a water swivel 24, for delivering rinsing water to the drill tube.

A chuck 27 for transferring rotational and axial movements to the drill string 23 is mounted beneath the gear housing 14. This chuck accompanies the gear housing 14 as it moves axially.

FIG. 2 is a longitudinal sectioned view of the gear housing. The illustrated housing 14 is comprised of two parts, an upper gear-accommodating part 28 and a lower part 29, said parts being joined together by means of a screw assembly 30. The actual tubular drill shaft 31 is journalled in the gear housing 14. A gear wheel 32 is secured to the shaft 31 by means of a screw joint 33. The gear wheel 32 meshes with a gear drive 34 which is securely wedged on the shaft of a hydraulic motor 35. When drilling is in operation, the drill string 23 extends through the shaft 31 and is fastened in the chuck 27.

The chuck 27 is fastened in the lower end of the shaft 31 and rotates with said shaft. The chuck itself forms no part of the present invention and will not therefore be described in detail. The chuck used may have the form described in SE 448 017. All that need be said about the chuck is that pressure fluid must be delivered to the chuck, even when it rotates, in order to manoeuvre its jaws into engagement with the tube string. The housing part 29 is provided to this end with a commutator 36 which delivers pressure fluid from an inlet 37 in the fixed housing part 29 through a channel 38 provided in the shaft 31.

According to the invention, the shaft is journalled in only one journal bearing, more specifically in a rolling bearing 39, in the illustrated case a ball bearing. This enables the shaft to position itself freely in the bearing without risk of jamming or binding in the bearing. The bearing 39 may also receive the shaft in the absence of any play, ie in a close fit, or may even be pre-stressed, which is particularly advantageous in impact drilling operations.

This construction, which includes only one single bearing, is made possible by a particular configuration of the commutator 36. The commutator is comprised of two commutator rings 40 which abut the shaft 41 with a small clearance therebetween. Each of the commutator rings 40 lies against a respective end-wall of a commutator chamber 41 and the rings are pressed away from one another towards the end-walls of the commutator chamber, by the pressure of fluid in the commutator chamber. This results in the exposure of passageways 42 in the shaft 31, these passageways connecting the commutator chamber with the passageways 48 through which pressure fluid is delivered to the chuck 27. The commutator rings are held in sealing abutment with the part 29 of the gear housing by means of O-rings 43 fitted at respective ends of the commutator chamber 41.

The construction of the commutator 36 enables the commutator to accompany any obliqueness or eccentricity in the position of the shaft. Because the commutator is divided in two, i.e. is divided into two commutator rings 40, the axial play is "self-closing", so as to prevent the occurrence of any gaps which would cause the O-rings to be worn or damaged as a result of penetrating through such gaps if present. It is not necessary for the commutator room to have any high degree of accuracy with regard to axial measurements, which also applies to the axial measurements of the commutator rings. The rings are prevented from rotating with the shaft by means of a screw or pin (not shown) which engages a recess or aperture in the rings 40.

We claim:

1. A shaft bearing in a rock and ground-drilling machine comprising a gear housing (14) in which there is journalled a shaft (31) which surrounds a drill string (23) in the manner of a sleeve and which is affixed to the drill string by means of a chuck (27) connected to the shaft (31), wherein the chuck is operated by means of pressure fluid which is delivered to the chuck (27) through the medium of a commutator (36) acting between the gear housing (14) and the shaft (31), characterized in that the shaft (31) is journalled in the gear housing (14) by means of one single rolling bearing (39); and in that the commutator (36) lies resiliently against the gear housing (14) and is flexible with regard to sideways movement of the shaft (31).

2. A shaft bearing according to claim 1, characterized in that the commutator (36) includes two commutator rings (40) which are movably arranged in a commutator chamber (41) and lie against the shaft (31); and in that the shaft includes pressure fluid passageways (42) which open out between the commutator rings (40).

3. A shaft bearing according to claim 2, characterized by an O-ring (43) positioned at each axial end of the commutator chamber (41) radially outwards of the commutator rings (40) and functioning to seal against the gear housing (14).

4. A shaft bearing according to claim 3, characterized in that the commutator rings include a recess or aperture which receives a screw or pin for preventing rotation of the rings together with the shaft.

5. A shaft bearing according to claim 2, characterized in that the commutator rings (40) include a recess or aperture which receives a screw or pin for preventing rotation of the rings together with the shaft (31).

* * * * *